US009537229B2

(12) United States Patent
Mundle

(10) Patent No.: US 9,537,229 B2
(45) Date of Patent: Jan. 3, 2017

(54) ELECTRICAL GROUNDING DEVICE

(71) Applicant: R U GROUNDED ENERGY INC., Calgary (CA)

(72) Inventor: Terry D. Mundle, Cochrane (CA)

(73) Assignee: R U GROUNDED ENERGY INC., Calgary (CA)

( * ) Notice: Subject to any disclaimer, the term of this patent is extended or adjusted under 35 U.S.C. 154(b) by 0 days.

(21) Appl. No.: 14/528,403

(22) Filed: Oct. 30, 2014

(65) Prior Publication Data

US 2016/0126645 A1 May 5, 2016

(51) Int. Cl.
*H01B 1/02* (2006.01)
*H01R 4/66* (2006.01)
*H01R 43/00* (2006.01)

(52) U.S. Cl.
CPC . *H01R 4/66* (2013.01); *H01B 1/02* (2013.01)

(58) Field of Classification Search
CPC ..... H01R 4/66; H01B 1/02
USPC ..... 174/7, 2, 5 R, 6, 51, 40 R
See application file for complete search history.

(56) References Cited

U.S. PATENT DOCUMENTS 2,545,048 A 3/1951 Salmons
2,716,148 A * 8/1955 Kretzer ..... H01R 4/66 174/7
3,498,588 A * 3/1970 Turner, Jr. ..... E04H 12/2215 256/47
4,743,998 A * 5/1988 Wu ..... H02H 3/16 174/6
6,815,607 B1 * 11/2004 Gingras ..... E04H 12/2215 174/6
2013/0192652 A1 * 8/2013 Simonson ..... E04H 15/62 135/118

OTHER PUBLICATIONS (Feb. 23, 2015) CIPO office action re CA 2,869,476.
(May 25, 2015) Response to CIPO office action re CA 2,869,476.
(Aug. 4, 2015) Notice of Allowance re CA 2,869,476.

* cited by examiner

*Primary Examiner* — Jenny L Wagner
*Assistant Examiner* — Michael E Moats, Jr.
(74) *Attorney, Agent, or Firm* — Donald V. Tomkins

(57) ABSTRACT

An electrical grounding device comprises an elongate shaft with plate members projecting radially outward from a lower region of the shaft. The shaft and plate members are made of an electrically-conductive material, and are connected such that an electric current can flow between the plates and the shaft. The device is installed by boring a hole into the earth to a selected depth less than the length of shaft above the plates. The grounding device is inserted into the borehole and driven into the earth below the borehole until the upper end of the shaft projects a desired distance above the adjacent earth surface, leaving the shaft projecting sufficiently to allow connection of grounding cables. The borehole is preferably filled with gravel or other suitable fill material, and water may be added to the fill to enhance electrical conductivity between the device and the earth.

10 Claims, 2 Drawing Sheets

ELECTRICAL GROUNDING DEVICE

FIELD OF THE DISCLOSURE

The present disclosure relates in general to electrical grounding devices, for use in either permanent or temporary installations.

BACKGROUND

For various well-known reasons, it is commonly necessary to use grounding electrodes to provide permanent electrical connections between metal structures and the earth. The most common type of grounding electrodes are grounding rods, typically 8 to 10 feet long, that are driven completely or almost completely into the earth. Electrical connections are made from the grounding rods to the structures being grounded, using suitable electrical conductors (e.g., grounding cables). Augered grounding rods are commonly used as alternatives to driven grounding rods.

An ideal grounding connection maintains zero voltage regardless of how much electrical current flows into or out of the earth. The quality of a grounding connection may be improved in a number of ways, by, for example:

- increasing the surface area of grounding electrode coming into contact with the earth;
- increasing the depth to which the grounding rod is driven or augered (in cases where the grounding electrode is a driven or augered grounding rod);
- using multiple connected electrodes;
- increasing the moisture content of the soil surrounding the electrode(s);
- improving the conductive mineral content of the soil; and/or
- increasing the earth surface area covered by the grounding system.

To ensure that a sufficient electrical connection from the grounded structure to the earth is achieved, it is commonly required by government regulation and/or industry practice that the electrical resistance between an installed grounding electrode and the earth must be less than 25 ohms, and this typically must be confirmed by testing before the grounding electrode is put into service. The factors influencing the level of electrical resistance developed between a grounding electrode and the earth include soil type and moisture conditions, which can vary over time. Generally speaking, the presence of moisture in the soil will increase electrical conductivity between a grounding electrode and the earth will be greater, resulting in lower electrical resistance (as previously noted).

Driven grounding rods have proven to be effective if properly installed, but proper installation is not always easy or even possible in some types of terrain and soil conditions. For example, if a grounding rod hits a rock while it is being driven into the earth, "mushrooming" can occur at one or both ends of the relatively soft steel rod, due to the increased axial force acting on the rod a result of impacting the rock. It is also known for driven grounding rods to be bent due to hitting underground rocks such that their path through the earth is deflected significantly as the rod-driving process continues. It is even known in such circumstances for grounding rods to be bent and deflected so much that their lower ends emerge above the earth surface a few feet from the insertion point. These and other installation defects and deficiencies can result in excessive resistance begin developed by an installed grounding rod, which may necessitate installation of a second rod bonded to the defectively-installed rod and electrically bonded thereto, in order to result in a satisfactorily-low resistance value for the complete installation.

However, even when soil conditions are readily conducive to grounding rod installation, the presence of buried utilities (e.g., gas lines, electrical power lines, water lines) can give rise to the risk of personal injury and expensive utility repair costs should such buried utilities be contacted or penetrated by grounding rods during the rod installation process. These latter risks can be mitigated or avoided by the use of grounding mats that do not have earth-penetrating elements, but such devices may have less than desired or optimal functional effectiveness, and they typically are not suitable in situations where permanent grounding is required.

Another practical disadvantage of the conventional 8-to-10-foot grounding rod is that a ladder or other means is needed to access the upper end of the rod to initiate the process of driving the rod into the earth. This is a safety concern, as workers have been injured after falling from an unstable ladder or other temporary support means while trying to pound a grounding rod into the earth.

BRIEF SUMMARY

The present disclosure teaches an electrical grounding device that can be installed with conventional equipment and which provides effective grounding without penetrating as far into the earth as conventional driven or augered grounding rods.

One embodiment of an electrical grounding device in accordance with the present disclosure comprises an elongate shaft having an upper end and a lower end, with four plate members structurally connected to and projecting generally radially outward from a lower region of the shaft. The shaft and the plate members are made of an electrically-conductive material (such as steel, to provide one non-limiting example), and the plates and shaft are connected such that an electric current can flow between the plates and the shaft. This required electrical conductivity will typically be provided by a structural weld connecting the plates and the shaft.

In one variant embodiment, the shaft is a 4-foot-long, ¾-inch-square steel bar, with four ¼-inch-thick plate members, each 3 inches wide and 15 inches long. The plates are arrayed at 90-degree intervals around the shaft, and welded to the shaft such that each plate projects 3 inches radially outward from the shaft. In other embodiments, the shaft could be made from solid round rod, round pipe, or square or rectangular hollow structural tubing. The length of the shaft, the dimensions of the plates, and the number of plates could all be different from the example described above, without departing from the scope of the present disclosure.

Optionally, separate ground connection terminal means for connecting electrical grounding cables may be provided in an upper region of the shaft. Such ground connection terminal means could be provided in any functionally suitable form, and embodiments in accordance with the present disclosure are not limited or restricted to the use of any particular type of ground connection terminal means. By way of non-limiting example, the ground connection terminal means could be as simple as a steel bar welded to the shaft in a transverse orientation relative thereto. In fact, some embodiments may have no separate ground terminal means, with an upper region of the shaft itself serving as a suitable component for connection of electrical grounding cables.

To install the grounding device, a hole of suitable diameter is bored into the earth, to a selected depth that is less than the length of shaft extending above the plates. For example, for the particular variant described above, with a 4-foot shaft and 3-inch by 15-inch plates, a suitable borehole depth might be 30 inches, and a suitable borehole diameter might be 6 to 8 inches. The grounding device is lowered into the borehole (if the borehole radius is larger than the radial distance from the shaft centerline to the radially outermost edge of the plates) or forced or driven into the borehole (if the borehole radius is smaller than the radial distance from the shaft centerline to the radially outermost edge of the plates), until the lower end of the device reaches the bottom of the borehole. The device is then driven into the earth below the bottom of the borehole (by application of downward force to the upper end of the shaft) until the upper end of the shaft projects a desired distance above the adjacent earth surface, leaving the shaft projecting sufficiently to allow connection of grounding cables to the upper end of the shaft or any associated ground connection terminal means.

To facilitate driving of the device into the earth below the bottom of the borehole, the lower and outer edges of the plates optionally may be provided with a bevelled or knife-edge profile to reduce resistance to penetration into the earth. As well, the outer lower corners of the plates optionally may be chamfered to facilitate initial insertion of the device into the borehole, which may be particularly helpful when the borehole radius is smaller than the radial distance from the shaft centerline to the radially outermost edge of the plates.

After the grounding device has been driven to a desired depth, the borehole may be filled with a suitable fill material, such as but not limited to gravel. For reasons explained previously herein, rain or runoff entering the fill in the borehole will beneficially reduce electrical resistance between the grounding device and the earth, thus enhancing the effectiveness of any grounding connection made between the grounding device and a structure or other installation. Water may then be added to the fill for this purpose, and water may also be added periodically afterward, as may be desirable (such as during dry weather).

Although installation of a grounding device in accordance with the present disclosure may be accomplished most efficiently and effectively by inserting the device into a borehole before driving it into the earth (as described and illustrated herein), it is also feasible to drive the device into the earth directly from the earth surface, without providing a borehole.

The grounding device, installed as described above, facilitates effective grounding while penetrating less than 4 feet into the earth. The plates provide the device with a total surface area considerably greater than for a conventional grounding rod, resulting in less electrical resistance between the device and the earth than would develop with a considerably longer rod. Since the device does not penetrate as far into the earth as a conventional grounding rod, it is less likely to encounter obstacles during the installation process.

BRIEF DESCRIPTION OF THE DRAWINGS

Embodiments in accordance with the present disclosure will now be described with reference to the accompanying Figures, in which numerical references denote like parts, and in which.

DETAILED DESCRIPTION

Figure 1:
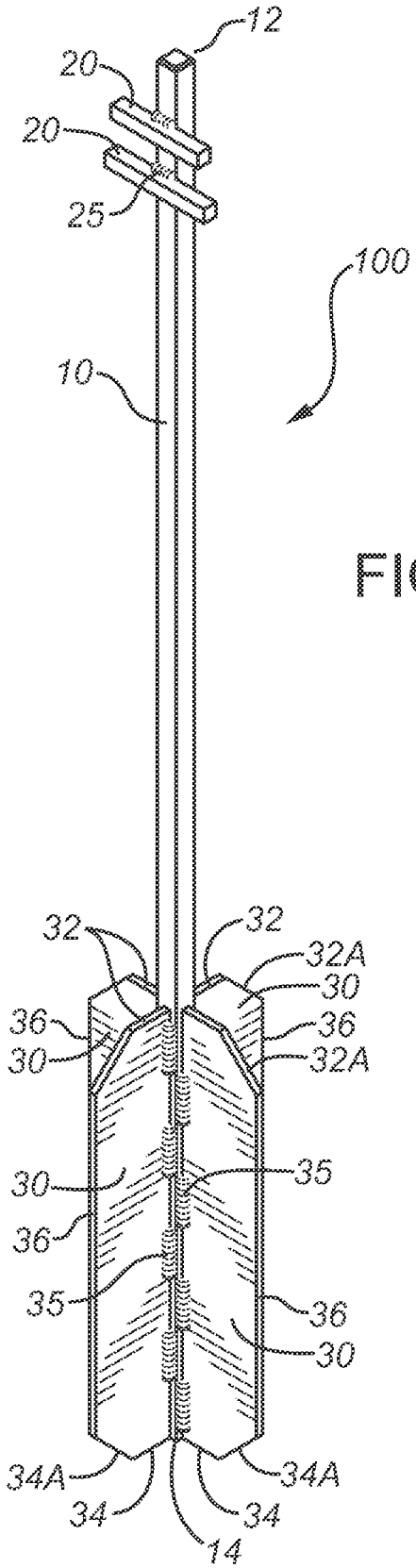
FIG. 1 is an isometric of one embodiment of an electrical grounding device in accordance with the present disclosure.
Figure 2:
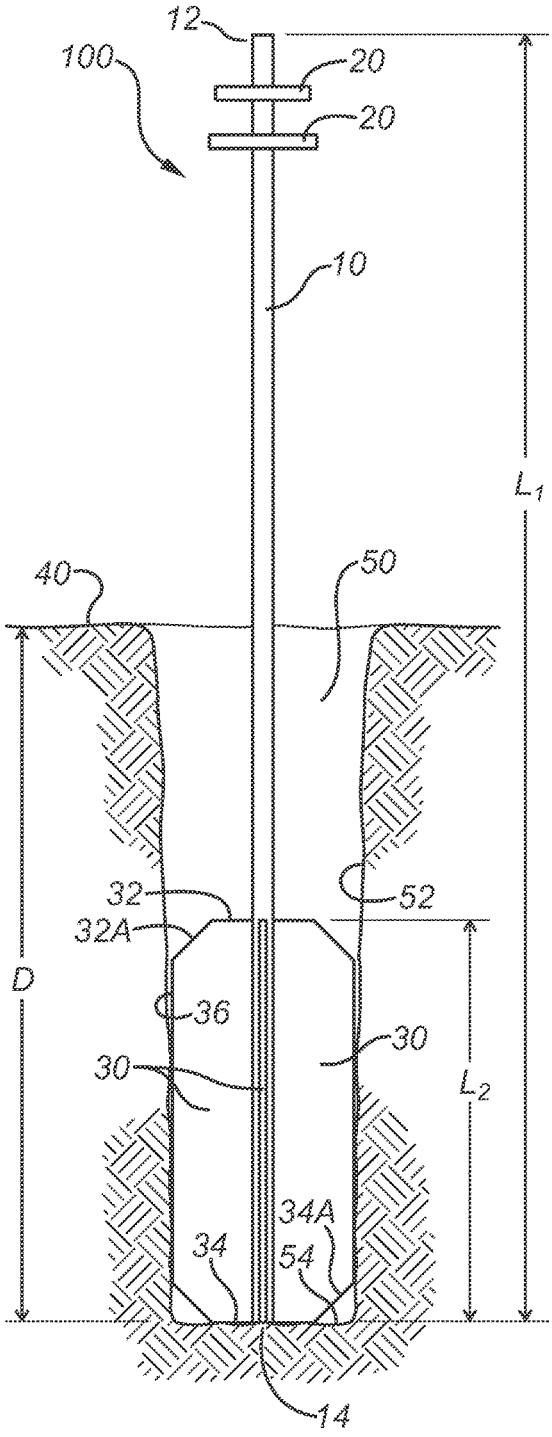
FIG. 2 is an elevational view depicting a first stage in the process of installing the electrical grounding device of FIG. 1 in a borehole.
Figure 3:
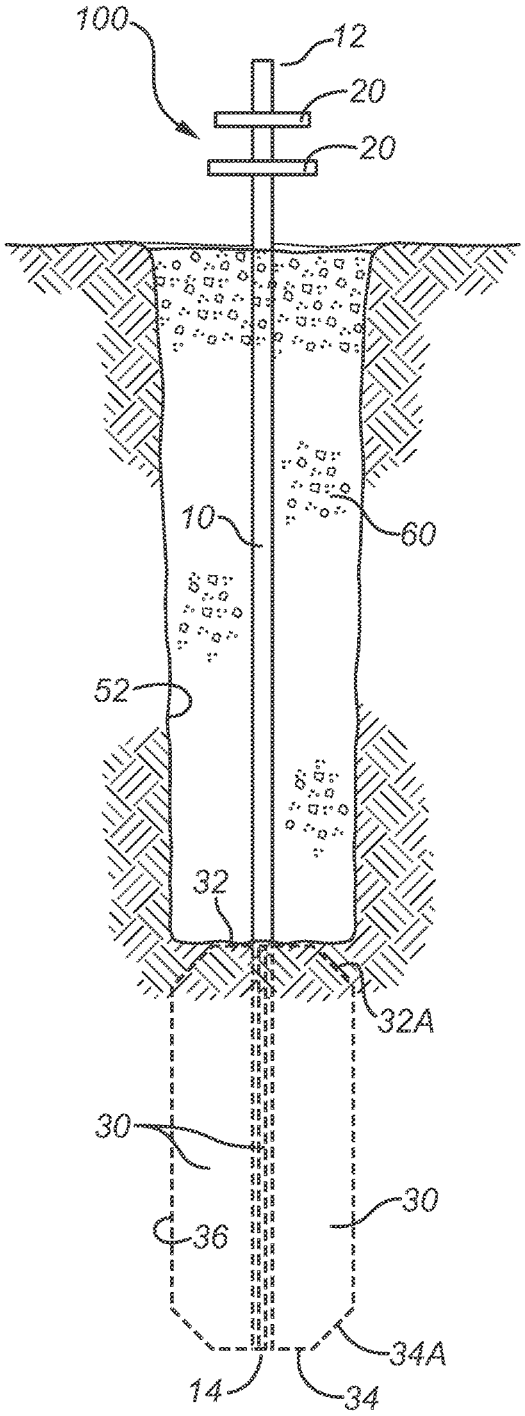
FIG. 3 illustrates the electrical grounding device after completion of the installation process.

FIGS. 1, 2, and 3 illustrate one embodiment of an electrical grounding device 100 in accordance with the present disclosure. Grounding device 100 includes an elongate shaft 10 made from an electrically-conductive material and having a selected length $L_1$, an upper end 12, and a lower end 14. Grounding device 100 also includes one or more electrically-conductive plate members 30 extending radially outward from and connected (such as by welds 35) to shaft 10 proximal to its lower end 14, such that electrical current can flow between shaft 10 and plates 30. The illustrated embodiment has four plates 30 arrayed at approximately equal (90-degree) angular intervals around shaft 10, but this is by way of example only. Although plates 30 are shown as extending to lower end 14 of shaft 10, in alternative embodiments, lower end 14 of shaft 10 could project below plates 30, or plates 30 could extend below lower end 14 of shaft 10.

Variant embodiments could have more or fewer plates 30, and in fact could have only a single plate 30 projecting from shaft 10 (although it will be preferable to have at least two plates 30, as a generally symmetrical plate arrangement will typically facilitate installation of device 100). In other variant embodiments, plates 30 could be arrayed around shaft 10 at unequal angular intervals. As well, the planes of plates 30 could be offset from the centerline of shaft 10 rather than being in precise radial alignment with the shaft centerline as in the illustrated embodiment.

Each plate member 30 has an inner side edge 31, an upper edge 32, a lower edge 34, and an outer side edge 36. Typically (but not necessarily), all plate members 30 will be of the same basic configuration, with side edges 31 and 36 having a nominal length $L_2$, which will be a selected amount less than shaft length $L_1$. In one exemplary embodiment, shaft length $L_1$ is 48 inches and plate length $L_2$ is 15 inches. However, other dimensional configurations may be used for shaft 10 and plates 30 without departing from the scope of the disclosure. Optionally, upper edges 32 and lower edges 34 may have chamfered edges 32A, 34A (respectively). Optionally, any or all of side edges 31, bottom edges 34, and chamfered edges 34A may be bevelled or knife-edged to facilitate penetration into the earth.

In the illustrated embodiment, separate ground connection terminal means are provided (by way of non-limiting example) in the form of one or more metal bars 20 connected to shaft 10 (by welds 25) proximal to upper end 12 of shaft 10, to facilitate connection of one or more grounding cables for establishing an electrical connection between grounding device 100 and a structure or other installation needing to be grounded. Variant embodiments could use other appurtenances for ground connection terminal means to facilitate connection of grounding cables. Other embodiments could have no ground connection terminal means separate from shaft 10, with the intent being for grounding cables to be connected directly to shaft 10.

FIGS. 2 and 3 illustrate typical steps involved in installing grounding device 100. First, a borehole 50 is drilled into the earth to a selected depth D below earth surface 40, and then grounding device 100 is lowered (or driven, as necessary) into borehole 50 until it reaches the bottom of borehole 50 (as shown in FIG. 2). The only practical restriction with respect to borehole depth D is that it should be sufficiently less than shaft length $L_1$ such that after installation, grounding device 100 will extend a sufficient distance above earth surface 40 to enable connection of grounding cables to grounding device 100.

In a typical installation, the diameter of borehole 50 will be roughly equivalent to the distance between the outer side edges 36 of two radially-opposing plates 30. This sizing of borehole 50 will help to keep grounding device 100 in axial alignment with borehole 50 during the installation of grounding device 100. However, a larger borehole diameter could be used without departing from the scope of the present disclosure. As well, it would be within the scope of the disclosure to use a smaller borehole diameter, such that the outer side edges 36 of plates 30 will penetrate sidewall 52 of borehole 50 as grounding device 100 is being inserted into borehole 50 (in which case the procedure may require application of vertical force to upper end 12 of shaft 10). After grounding device 100 has bottomed out in borehole 50, further vertical force is applied to upper end 12 of shaft 10 to drive grounding device 100 a desired distance into the earth below the bottom of borehole 50, leaving an upper portion of shaft 10 (including ground connection terminal means 20, if present) projecting a desired distance above ground surface 40, all as shown in FIG. 3. Borehole 50 may then be filled with gravel 60 or other suitable fill material, and water may be added to the fill.

It will be readily appreciated by those skilled in the art that various modifications to embodiments in accordance with the present disclosure may be devised without departing from the scope and teaching of the present teachings, including modifications which may use equivalent structures or materials hereafter conceived or developed. It is to be understood that the scope of the claims appended hereto should not be limited by the preferred embodiments described and illustrated herein, but should be given the broadest interpretation consistent with the description as a whole. It is also to be understood that the substitution of a variant of a claimed element or feature, without any substantial resultant change in functionality, will not constitute a departure from the scope of the disclosure.

In this patent document, any form of the word "comprise" is to be understood in its non-limiting sense to mean that any item following such word is included, but items not expressly mentioned are not excluded. A reference to an element by the indefinite article "a" does not exclude the possibility that more than one such element is present, unless the context clearly requires that there be one and only one such element. Any use of any form of the words "connect", "attach", or any other terms describing an interaction between elements is not intended to limit that interaction to direct interaction between the subject elements, and may also include indirect interaction between the elements such as through secondary or intermediary structure.

Wherever used in this document, the terms "typical" and "typically" are to be understood in the sense of representative or common usage or practice, and are not to be understood as implying invariability or essentiality.

In this document, the terms "ground" and "earth" may be alternatively used with express or implicit reference to the physical earth or soil. In addition, the term "ground" is used in both noun and verb forms with reference to electrical grounding and electrical ground connections. The intended meaning of any form of the word "ground" in a given instance will be readily apparent to persons skilled in the art having due regard to the context in which it is used.

What is claimed is:

1. A grounding device comprising:

(a) an elongate shaft made from an electrically-conductive material, and having an upper end, a lower end, and a shaft length; and (b) one or more plate members made from electrically-conductive material;

wherein:

(c) each plate member has a plate width, a plate length, and a plate thickness, said plate thickness being less than the plate width and less than the plate length;

(d) each plate member is characterized by a plane defined by the plate member's plate width and plate length;

(e) each plate member has an inner side edge, an outer side edge, an upper edge, and a lower edge, with the length of the inner side edge corresponding to the plate length and being at least 24 inches less than the shaft length; and (f) each plate member is connected along its inner side edge to a lower region of the shaft such that the plane of the plate member extends generally radially outward from the shaft, and such that electrical current can flow between the shaft and the one or more plate members.

2. A grounding device as in claim 1, further comprising ground connection terminal means connected to the shaft proximal to the upper end thereof, such that electrical current can flow between the ground connection terminal means and the shaft.

3. A grounding device as in claim 2 wherein the shaft is made from steel, and the ground connection terminal means comprises a steel bar welded to the shaft in an orientation transverse to the shaft.

4. A grounding device as in claim 1 wherein the total number of plate members is at least two, and wherein the plates are arrayed at approximately equal angular intervals around the shaft.

5. A grounding device as in claim 1 wherein the plane of at least one of the one or more plate members is offset from the centerline of the shaft.

6. A grounding device as in claim 1 wherein the outer side edge of at least one of the one or more plate members is bevelled.

7. A grounding device as in claim 1 wherein the lower edge of at least one of the one or more plate members is bevelled.

8. A method for grounding a structure, comprising the steps of:

(a) providing a grounding device in accordance with claim 1;

(b) boring a borehole into an earth surface, to a selected depth less than the length of the shaft of the grounding device;

(c) inserting the grounding device into the borehole until the lower end of the grounding device reaches the bottom of the borehole;

(d) applying vertically-downward force to the upper end of the grounding device until the lower end of the grounding device penetrates the earth a selected distance below the bottom of the borehole, leaving the upper end of the grounding device projecting a selected distance above the earth surface;

(e) placing a selected fill material into the borehole; and (f) electrically connecting the grounding device to the structure to be grounded.

9. The method of claim 8, further comprising the step of adding water to the fill material in the borehole.

10. A method for grounding a structure, comprising the steps of:

(a) providing a grounding device in accordance with claim 1;

(b) positioning the grounding device on an earth surface in a generally vertical orientation;

(c) applying vertically-downward force to the upper end of the grounding device until the lower end of the grounding device penetrates a selected distance below the earth surface, leaving the upper end of the grounding device projecting a selected distance above the earth surface; and (d) electrically connecting the grounding device to the structure to be grounded.

* * * * *